US010987932B2

(12) United States Patent
Usui et al.

(10) Patent No.: US 10,987,932 B2
(45) Date of Patent: Apr. 27, 2021

(54) RECORDING HEAD RECOVERY METHOD

(71) Applicant: KYOCERA Document Solutions Inc., Osaka (JP)

(72) Inventors: Masato Usui, Osaka (JP); Yasuko Takaori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/476,809

(22) PCT Filed: Dec. 1, 2017

(86) PCT No.: PCT/JP2017/043262
§ 371 (c)(1),
(2) Date: Jul. 9, 2019

(87) PCT Pub. No.: WO2018/159044
PCT Pub. Date: Sep. 7, 2018

(65) Prior Publication Data

US 2019/0358958 A1 Nov. 28, 2019

(30) Foreign Application Priority Data

Mar. 3, 2017 (JP) ..... JP2017-040755

(51) Int. Cl.
*B41J 2/165* (2006.01)

(52) U.S. Cl.
CPC ..... *B41J 2/16552* (2013.01); *B41J 2/16538* (2013.01); *B41J 2/16508* (2013.01);
(Continued)

(58) Field of Classification Search
CPC ..... B41J 2/16552; B41J 2002/16558; B41J 2002/16594; B41J 2202/20; B41J 2/16538; B41J 2/16508; B41J 2/16585
See application file for complete search history.

(56) References Cited

U.S. PATENT DOCUMENTS

2006/0066663 A1* 3/2006 Takagi ..... B41J 2/16535 347/33
2007/0019045 A1* 1/2007 Umeda ..... B41J 29/38 347/84
2013/0194361 A1* 8/2013 Takahashi ..... B41J 2/19 347/92

FOREIGN PATENT DOCUMENTS

JP 2006-88617 A 4/2006
JP 2007-83496 A 4/2007
(Continued)

*Primary Examiner* — Yaovi M Ameh
(74) *Attorney, Agent, or Firm* — Stein IP, LLC

(57) ABSTRACT

A method for recovery of a recording head includes cleaning liquid supplying operation, wiping operation, and backflow operation. The recording head is connected to a cleaning liquid tank for storing cleaning liquid via a cleaning liquid supplying path. In the backflow operation, a liquid supply mechanism makes the cleaning liquid in the cleaning liquid supplying path to flow backward in a direction pointing from the cleaning liquid supplying openings to the cleaning liquid tank. The recording head includes an ink ejection region in which ink ejection openings are open, and a cleaning liquid supplying region which is arranged upstream of the ink ejection region in a wiping direction and in which cleaning liquid supplying openings are open. The backflow operation is performed after a wiper passes the cleaning liquid supplying region and before the wiper reaches the ink ejection region.

6 Claims, 7 Drawing Sheets

(52) U.S. Cl.
CPC .. *B41J 2/16585* (2013.01); *B41J 2002/16558* (2013.01); *B41J 2002/16594* (2013.01); *B41J 2202/20* (2013.01)

(56) References Cited

FOREIGN PATENT DOCUMENTS

| | | | | | |
|---|---|---|---|---|---|
| JP | 2007083496 | A | * | 4/2007 | ..... B41J 2/165 |
| JP | 2016-43587 | A | | 4/2016 | |
| JP | 2016-68422 | A | | 5/2016 | |

* cited by examiner

RECORDING HEAD RECOVERY METHOD

TECHNICAL FIELD

The present invention relates to a recovery system for a recording head having ink ejection openings for ejecting ink on a recording medium such as a sheet, to an ink-jet recording apparatus provided with such a recording head recovery system, and to a recording head recovery method.

BACKGROUND ART

As recording apparatuses such as facsimile machines, copiers, and printers, ink-jet recording apparatuses, which form images by ejecting ink, are widely used for their ability to form high-definition images.

In such ink-jet recording apparatuses, fine ink droplets (hereinafter, referred to as mist) which are ejected together with ink droplets for image recording, and splashed mist which is generated when ink droplets attach to the recording medium, attach to and solidify on an ink ejection face of a recording head. As mist on the ink ejection face gradually increases and covers the ink ejection openings, it causes, for example, degraded straightness of the ink trajectory (curved flight) or ejection failure, and leads to degraded printing performance of the recording head.

To avoid that, in one known ink-jet recording apparatus, for cleaning the ink ejection face of the recording head, a plurality of cleaning liquid supplying openings are provided in a part of the ink ejection face outside an ink ejection region (upstream in the direction of wiping by a wiper) in which a plurality of ink ejection openings are open. In such an ink-jet recording apparatus, after the cleaning liquid is supplied from the cleaning liquid supplying openings, the wiper can be moved along the ink ejection face starting outward of the cleaning liquid supplying openings so that the wiper wipes the ink ejection face while holding the cleaning liquid. In this way, recovery operation for the recording head is performed.

An ink-jet recording apparatus provided with a plurality of cleaning liquid supplying openings on the ink ejection face of the recording head is disclosed, for example, in Patent Document 1 identified below.

LIST OF CITATIONS

Patent Literature

Patent Document 1: JP-A-2007-83496

SUMMARY OF THE INVENTION

Problem to be Solved by the Invention

However, in the conventional ink-jet recording apparatus mentioned above, after recovery processing for the recording head is performed, the cleaning liquid may be left around a cleaning liquid supplying opening. Inconveniently, in this case, when a recording medium touches the recording head, the cleaning liquid may attach to and soil the recording medium, or the cleaning liquid may drop and attach to a conveying belt and the like and soil the inside of the device.

The present invention has been made to solve the above problem. An object of the present invention is to provide a recording head recovery system which is configured to clean the ink ejection face while preventing the cleaning liquid from attaching to a recording medium or dropping, an ink-jet recording apparatus provided with such a recording head recovery system, and a recording head recovery method.

Means for Solving the Problem

According to one aspect of what is disclosed herein, a recording head recovery system comprises a recording head which includes an ink ejection face in which a plurality of ink ejection openings for ejecting ink on a recording medium are open, and a plurality of cleaning liquid supplying openings for supplying cleaning liquid which are arranged upstream of the ink ejection openings in a wiping direction in which a wiper wipes the ink ejection face; a cleaning liquid tank for storing the cleaning liquid to be supplied to the cleaning liquid supplying openings in the recording head; a cleaning liquid supplying path which connects together the cleaning liquid tank and the recording head; a liquid supply mechanism which is provided in the cleaning liquid supplying path and which includes a liquid supplying pump for supplying the cleaning liquid in the cleaning liquid tank to the recording head; and a controller which controls operation of the liquid supply mechanism. The controller is configured to perform the recording head recovery operation including cleaning liquid supplying operation for supplying the cleaning liquid from the cleaning liquid supplying openings by making the liquid supply mechanism supply the cleaning liquid in the cleaning liquid tank to the recording head via the cleaning liquid supplying path, wiping operation for wiping the ink ejection face while the wiper retains the cleaning liquid after performing the cleaning liquid supplying operation, and backflow operation for controlling the liquid supply mechanism to make the cleaning liquid in the cleaning liquid supplying path to flow backward in a direction pointing from the cleaning liquid supplying openings to the cleaning liquid tank while or after the wiping operation is performed.

Advantageous Effects of the Invention

With a recording head recovery system according to a first aspect of the present invention, recording head recovery operation including cleaning liquid supplying operation for supplying cleaning liquid from cleaning liquid supplying openings and wiping operation for wiping an ink ejection face while a wiper retains the cleaning liquid can be performed. With this, the ink ejection face can be cleaned.

Moreover, a liquid supply mechanism can perform backflow operation in which the cleaning liquid in the cleaning liquid supplying path is made to flow backward in the direction pointing from a cleaning liquid supplying openings to a cleaning liquid tank. This makes it possible to prevent the cleaning liquid to be left around the cleaning liquid supplying openings after recovery processing for the recording head is performed. This helps prevent, even if a recording medium touches the recording head, the cleaning liquid from attaching to and soiling the recording medium. This also helps prevent the cleaning liquid from dropping from the cleaning liquid supplying openings, and thus it is possible to prevent the cleaning liquid from attaching to a sheet conveying belt and the like and soiling the inside of the device.

This and other objects of the present invention, and the specific benefits obtained according to the present invention, will become apparent from the description of embodiments which follows.

DESCRIPTION OF EMBODIMENTS

Now, embodiments of the present invention are described with reference to the drawings.

Figure 1:
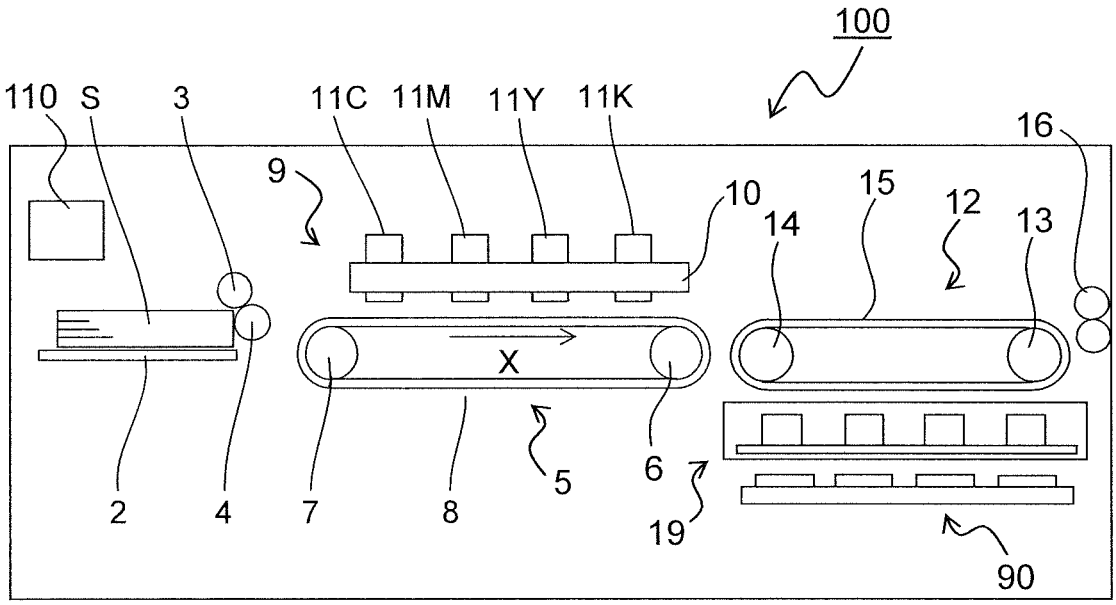
FIG. 1 A diagram showing the structure of an ink-jet recording apparatus provided with a recording head according to one embodiment of the present invention.

As shown in FIG. 1, in an ink-jet recording apparatus 100 according to one embodiment of the present invention, in a left-side part, a sheet feeding tray 2 which houses sheets S (a recording medium) is provided. At one end part of the sheet feeding tray 2, there are provided a sheet feeding roller 3 that coveys and feeds the housed sheets S one after another, starting with the top sheet S, to a first conveying unit 5, which will be described later, and a driven roller 4 that is in pressed contact with the sheet feeding roller 3 to rotate by following it.

On the downstream side (right side in FIG. 1), in the sheet conveying direction (arrow X direction), of the sheet feeding roller 3 and the driven roller 4, the first conveying unit 5 and a recording portion 9 are arranged. The first conveying unit 5 is configured to include a first driving roller 6, a first driven roller 7, and a first conveying belt 8 which is stretched between the first driving roller 6 and the first driven roller 7. According to a control signal from a controller 110 which controls the whole ink-jet recording apparatus 100, the first driving roller 6 is driven to rotate in the clockwise direction and thus a sheet S held on the first conveying belt 8 is conveyed in the arrow X direction.

Figure 2:
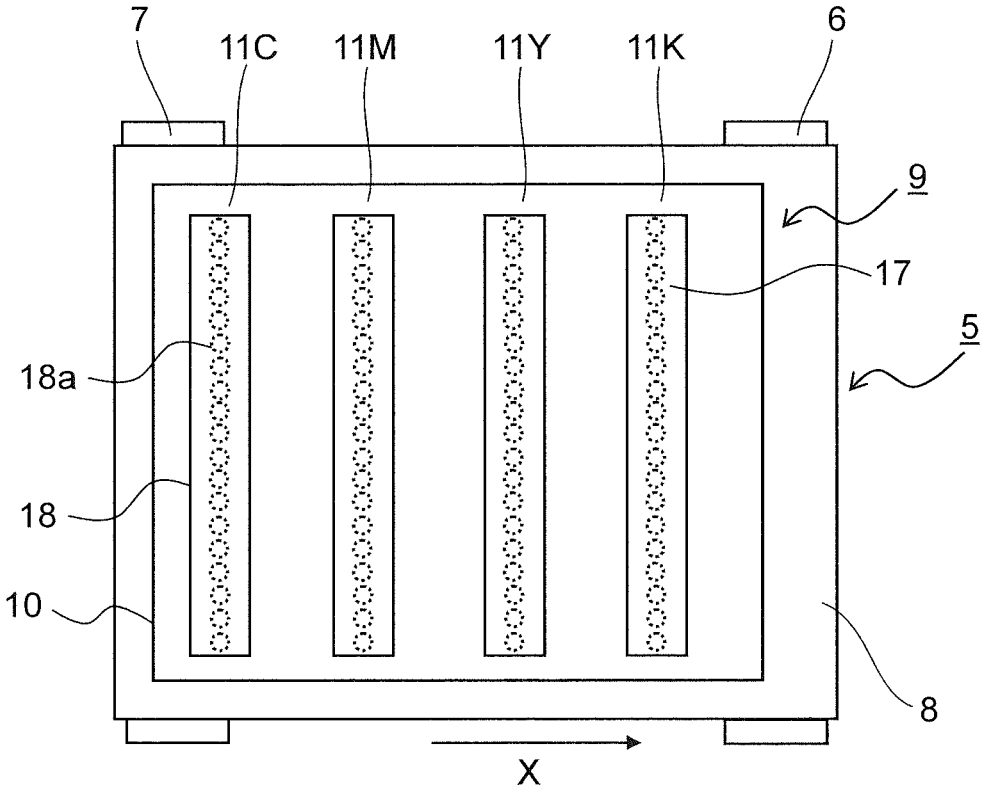
FIG. 2 A diagram showing a first conveying unit and a recording portion of the ink-jet recording apparatus shown in FIG. 1 as seen from above.

The recording portion 9 includes a head housing 10 and line heads 11C, 11M, 11Y and 11K which are held on the head housing 10. These line heads 11C to 11K are supported at such a height that a predetermined gap (for example, 1 mm) is formed relative to the conveying face of the first conveying belt 8. As shown in FIG. 2, the line heads 11C to 11K each include one or more (here, one) recording heads 17 which extend in the sheet width direction (up-down direction in FIG. 2) perpendicular to the sheet conveying direction.

Figure 3:
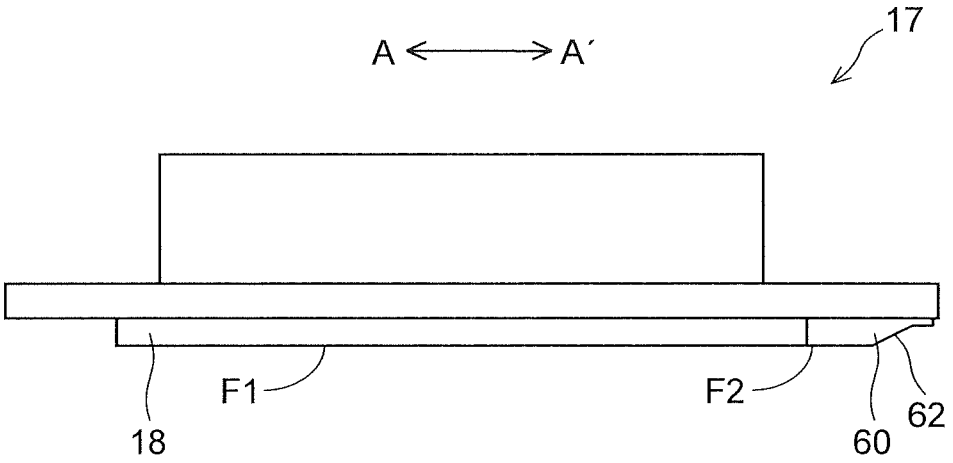
FIG. 3 A diagram showing the recording head which constitutes line heads in the recording portion.
Figure 4:
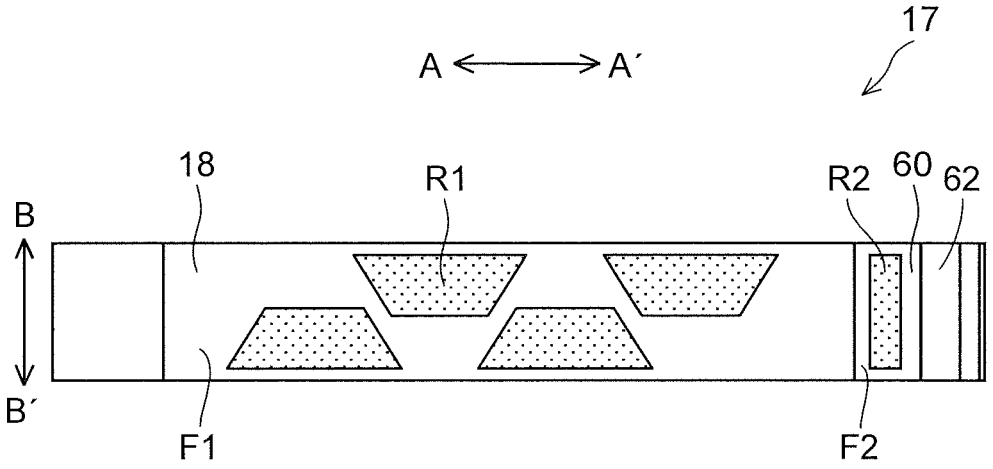
FIG. 4 A diagram showing the recording head as seen from the ink ejection face side.

As shown in FIGS. 3 and 4, at an ink ejection face F1 on a head portion 18 (ink ejection head portion) of the recording head 17, there is provided an ink ejection region R1 in which a number of ink ejection openings 18*a* (see FIG. 2) are arrayed. The diameter of each ink ejection opening 18*a* is set at, for example, 20 μm.

To the recording heads 17 each constituting either of the line heads 11C to 11K, ink of either of four colors (cyan, magenta, yellow, and black) corresponding to the color of each of the line heads 11C to 11K and each stored in an ink tank (unillustrated) for the corresponding color is supplied.

According to the control signal from the controller 110 (see FIG. 1), and based on image data received from an external computer, each recording head 17 ejects ink from the ink ejection openings 18*a* toward the sheet S which is conveyed while being held by absorption on the conveying face of the first conveying belt 8. In this way, a color image having ink of four colors, namely cyan, magenta, yellow and black, overlaid together is formed on the sheet S on the first conveying belt 8.

In the recording head 17, a cleaning liquid supplying member (cleaning liquid supplying head portion) 60 for supplying a cleaning liquid is provided. The cleaning liquid supplying member 60 is arranged adjacent to the head portion 18, on its upstream side (right side in FIG. 3) in the wiping direction of a wiper 35, which will be described later. The cleaning liquid supplying member 60 has a cleaning liquid supplying face F2 which includes a cleaning liquid supplying region R2 on which a number of cleaning liquid supplying openings 60*a* (see FIG. 5) for supplying the cleaning liquid are arrayed. The diameter of each cleaning liquid supplying opening 60*a* is set, for example, at 0.1 mm so as to be larger than that of each ink ejection opening 18*a*. On the head portion 18, at least the ink ejection face F1 is formed of, for example, SUS (stainless steel). On the cleaning liquid supplying member 60, at least the cleaning liquid supplying face F2 is formed of, for example, SUS or resin.

The cleaning liquid supplying face F2 is formed so as to be flush with the ink ejection face F1. In a part upstream (right-side in FIG. 3) of the cleaning liquid supplying face F2 in the cleaning liquid supplying member 60 in the wiping direction, an inclined face 62 is formed.

Figure 5:
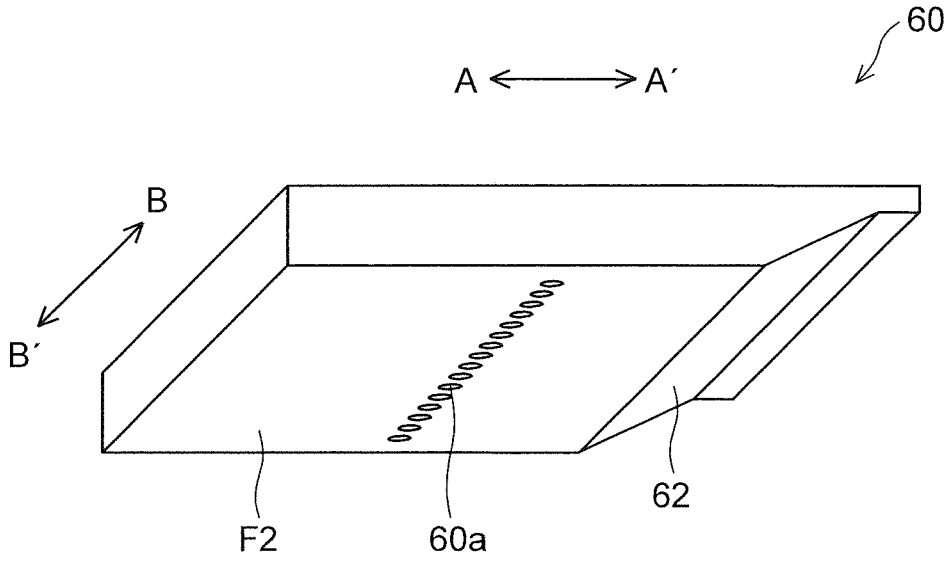
FIG. 5 A diagram showing a cleaning liquid supplying member of the recording head as seen from obliquely below.

As shown in FIG. 5, a plurality of cleaning liquid supplying openings 60*a* are arranged with a predetermined pitch in the head width direction (arrow BB' direction) perpendicular to the wiping direction (arrow A direction). FIG. 5 only shows one row of a plurality of cleaning liquid supplying openings 60*a* which are arranged along the head width direction, but a plurality of such rows may be provided adjacent to each other in the wiping direction (arrow A direction).

Figure 6:
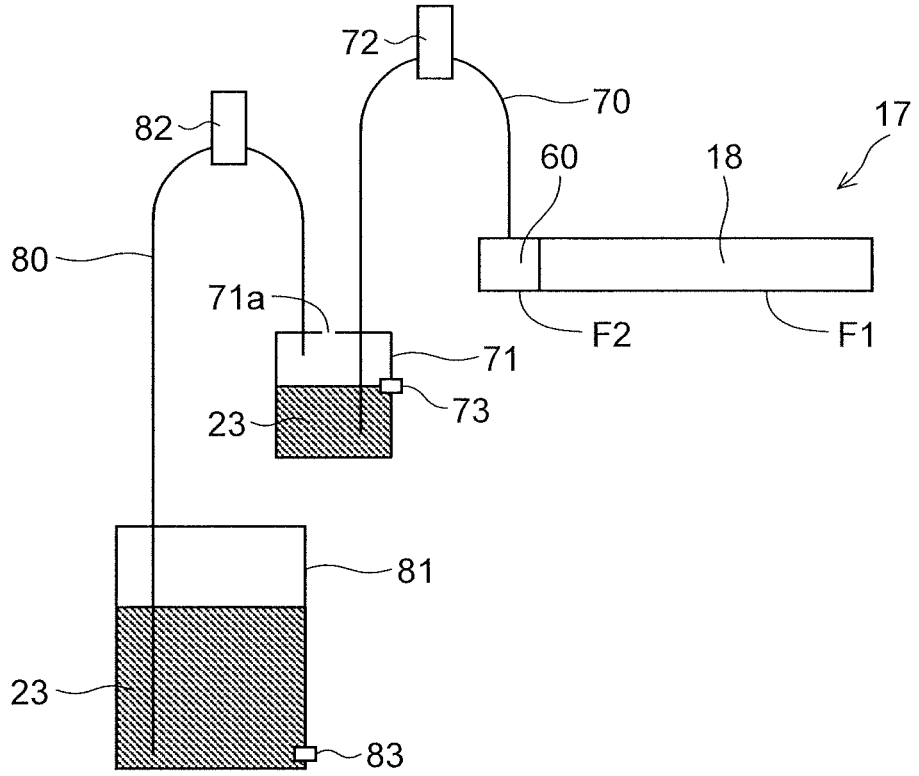
FIG. 6 A diagram showing the structure of and around the recording head, a subtank, and a main tank.

As shown in FIG. 6, the cleaning liquid supplying openings 60*a* (see FIG. 5) in the cleaning liquid supplying member 60 are connected to a downstream end of a cleaning liquid supplying path 70 comprising a tube through which cleaning liquid 23 passes. An upstream end of the cleaning liquid supplying path 70 is connected to a subtank (cleaning liquid tank) 71 in which is stored the cleaning liquid 23 to be supplied to the cleaning liquid supplying member 60. The upstream end of the cleaning liquid supplying path 70 is immersed in the cleaning liquid 23. The cleaning liquid supplying path 70 is provided with a supplying pump (liquid supplying pump) 72 that pumps up the cleaning liquid 23 from the subtank 71 to feed it to the cleaning liquid supplying member 60. In the diagram, the cleaning liquid 23 is indicated by hatching to facilitate understanding.

The subtank 71 is connected to a downstream end of a cleaning liquid replenishing path 80 comprising a tube through which the cleaning liquid 23 passes. An upstream end of the cleaning liquid replenishing path 80 is connected to a main tank 81 in which is stored the cleaning liquid 23 to be supplied to the subtank 71. The upstream end of the cleaning liquid replenishing path 80 is immersed in the cleaning liquid 23. The cleaning liquid replenishing path 80 is provided with a replenishing pump 82 that pumps up the cleaning liquid 23 from the main tank 81 to feed it to the subtank 71. For the replenishing pump 82, for example, a tube pump, a syringe pump, a diaphragm pump, or the like can be used. The detailed structure of and around the subtank 71 and the main tank 81 will be described later.

In this ink-jet recording apparatus 100, to clean the ink ejection face F1 on the recording head 17, at the start of printing after a long out-of-operation period and during intermissions of printing operation, ink is discharged forcibly from the ink ejection openings 18*a* in all the recording heads 17. Then the cleaning liquid 23 is supplied through the cleaning liquid supplying openings 60*a* (see FIG. 5) in all the recording heads 17 to the cleaning liquid supplying region R2, and the ink ejection face F1 is wiped with the wiper 35, which will be described later, in preparation for the next printing operation.

As shown back in FIG. 1, on a downstream side (right side in FIG. 1) of the first conveying unit 5 in the sheet conveying direction, a second conveying unit 12 is arranged. The second conveying unit 12 is configured to include a second driving roller 13, a second driven roller 14, and a second conveying belt 15 which is stretched between the second driving roller 13 and the second driven roller 14. The second driving roller 13 is driven to rotate in the clockwise direction and thus a sheet S held on the second conveying belt 15 is conveyed in the arrow X direction.

The sheet S with an ink image recorded on it at the recording portion 9 is conveyed to the second conveying unit 12. While the sheet S passes through the second conveying unit 12, the ink ejected on the surface of the sheet S is dried. Under the second conveying unit 12, a wipe unit 19 and a cap unit 90 are arranged. When wiping operation is performed by the wiper 35 as mentioned above, the first conveying unit 5 descends. Then the wipe unit 19 moves to under the recording portion 9, wipes off the ink discharged forcibly from the ink ejection openings 18*a* in the recording head 17 and the cleaning liquid 23 supplied from the cleaning liquid supplying openings 60*a*, and collects the ink and the cleaning liquid 23 that are wiped. When capping the ink ejection face F1 (see FIG. 3) on the recording head 17, the first conveying unit 5 descends. Then the cap unit 90 horizontally moves to under the recording portion 9, and then moves upward to be fitted to the lower face of the recording head 17.

On the downstream side of the second conveying unit 12 in the sheet conveying direction, there is provided a discharge roller pair 16 which discharges the sheet S with an image recorded on it to outside the apparatus main body. On the downstream side of the discharge roller pair 16, there is provided a discharge tray (unillustrated) on which the sheets S discharged outside the apparatus main body are stacked.

The wipe unit 19 includes a plurality of wipers 35 (see FIG. 10) which are movable along the ink ejection face F1, a substantially rectangular carriage (unillustrated) on which the plurality of wipers 35 are fixed, and a supporting frame (unillustrated) which supports the carriage. The carriage (unillustrated) is supported so as to be slidable in the arrow AA' direction relative to the supporting frame (unillustrated).

The wiper 35 is an elastic member (for example, a rubber member made of EPDM) for wiping the cleaning liquid 23 supplied from the cleaning liquid supplying openings 60*a* (see FIG. 5) in each recording head 17. The wiper 35 is kept in pressed contact with a part (here, the inclined face 62) upstream of the cleaning liquid supplying region R2 (see FIG. 4) in the cleaning liquid supplying member 60 in the wiping direction. As the carriage (unillustrated) moves, the wiper 35 wipes the cleaning liquid supplying face F2 and the ink ejection face F1 in the predetermined direction (arrow A direction).

Next, the structures of and around the cleaning liquid supplying member 60, the subtank 71 and the main tank 81 will be described in detail.

As shown in FIG. 6, at a predetermined position in the subtank 71, a first detection sensor 73 for sensing the cleaning liquid 23 is provided. The first detection sensor 73 has an electrode pair (unillustrated) to which a voltage is applied and which is arranged inside the subtank 71. The first detection sensor 73 can, based on whether a current is present between the electrodes, sense the presence or the absence of the cleaning liquid 23. When the first detection sensor 73 senses the absence of the liquid (absence of the current), the cleaning liquid 23 is supplied by the replenishing pump 82 from the main tank 81 to the subtank 71 until the presence of the liquid (presence of the current) is sensed. In this way, the liquid level (top face) of the cleaning liquid 23 inside the subtank 71 is substantially kept constant.

In a lower part of the main tank 81, a second detection sensor 83 for sensing the cleaning liquid 23 is provided. The second detection sensor 83 has an electrode pair (unillustrated) to which a voltage is applied and which is arranged inside the main tank 81. The second detection sensor 83 can, based on whether a current is present between the electrodes, sense the presence or the absence of the cleaning liquid 23. When the second detection sensor 83 senses the absence of the liquid, and a display panel (unillustrated) of the ink-jet recording apparatus 100 indicates that the main tank 81 has become empty. With this, a user or an operator replaces the main tank 81 with a new one, or replenishes the main tank 81 with the cleaning liquid 23.

The subtank 71 is arranged above the main tank 81 and below the cleaning liquid supplying face F2 of the recording head 17. The subtank 71 is provided with an atmospheric open port 71*a* for equalizing the pressure in its internal space with the atmospheric pressure.

Figure 7:
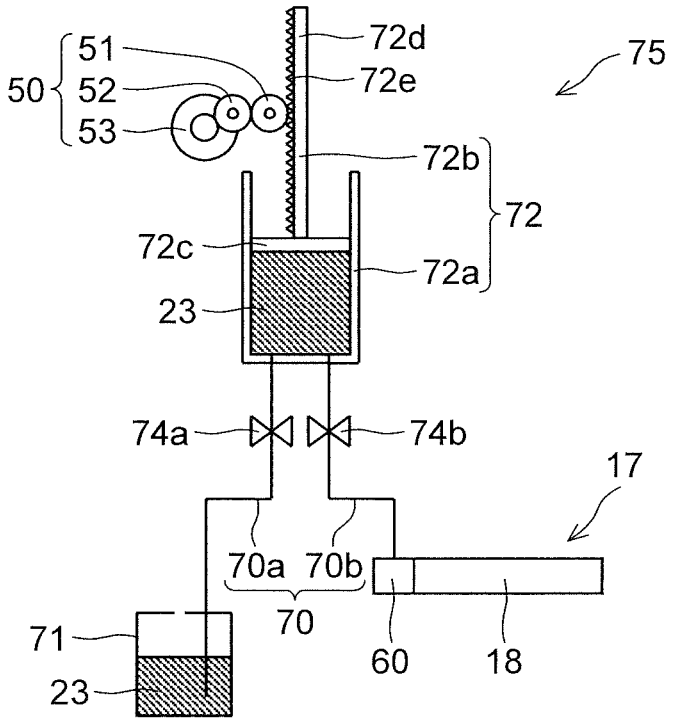
FIG. 7 A diagram showing the structure of and around the recording head, the subtank, and a liquid supply mechanism.

As shown in FIG. 7, the cleaning liquid supplying path 70 includes a first supplying path 70*a* which connects together the subtank 71 and the supplying pump 72 and a second supplying path 70*b* which connects together the supplying pump 72 and the cleaning liquid supplying member 60 of the recording head 17. The first supplying path 70*a* is provided with a first valve 74*a* which opens and closes the first supplying path 70*a*. The second supplying path 70*b* is provided with a second valve 74*b* which opens and closes the second supplying path 70*b*. The supplying pump 72, the first valve 74*a*, the second valve 74*b* and a pump driving mechanism 50, which will be described later, constitute a liquid supply mechanism 75 for supplying the cleaning liquid 23 in the subtank 71 to the recording head 17.

The supplying pump 72 is composed of a syringe pump having a cylinder 72*a* which is formed in a cylindrical shape and a piston 72*b* which is inserted in the cylinder 72*a* and which is reciprocatable in the axial direction of the cylinder. One end of the cylinder 72*a* (lower end in FIG. 7) is provided with an inlet port to which the first supplying path 70*a* is connected and an outflow port to which the second supplying path 70*b* is connected. The other end of the cylinder 72*a* (upper end in FIG. 7) is open and the piston 72*b* is inserted in there.

The piston 72*b* includes a disk portion 72*c* which slides on the inner circumferential face of the cylinder 72*a* and a shaft portion 72*d* which is fixed on the top face of the disk portion 72*c* and extends to outside the cylinder 72*a*. A plurality of rack teeth 72*e* are formed on the shaft portion 72*d*.

The rack teeth 72*e* is engaged with a driving gear 51. The driving gear 51 is connected to a drive motor 53 comprising a stepping motor via an intermediate gear 52. The driving gear 51, the intermediate gear 52 and the drive motor 53 constitute the pump driving mechanism 50 which drives the supplying pump 72. When the drive motor 53 rotates forward (rotates in the counter-clockwise direction in FIG. 7), the piston 72*b* moves in the extraction direction (upward in FIG. 7) with respect to the cylinder 72*a*, and the cleaning liquid 23 flows into the supplying pump 72. When the drive motor 53 rotates backward (rotates in the clockwise direction in FIG. 7), the piston 72*b* moves in the insertion direction (downward in FIG. 7) with respect to the cylinder 72*a*, and the cleaning liquid 23 in the supplying pump 72 flows out.

Next, recovery operation for the recording head 17 using the wipe unit 19 in the ink-jet recording apparatus 100 of this embodiment will be described. Recovery operation for the recording head 17 described below is performed by controlling the operation of the recording head 17, the wipe unit 19, the liquid supply mechanism 75, and the like based on the control signal from the controller 110 (see FIG. 1).

Figure 8:
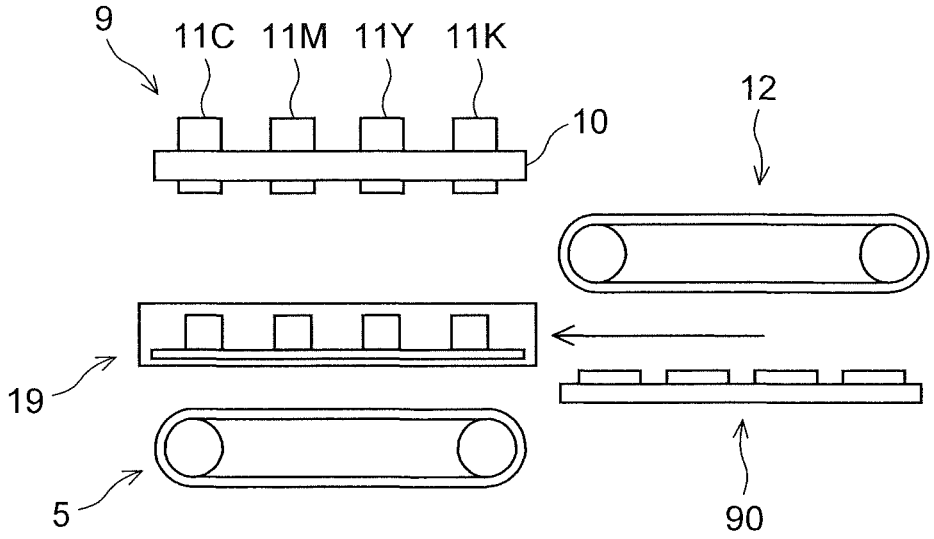
FIG. 8 A diagram showing a state where a wipe unit is arranged under the recording portion.
Figure 9:
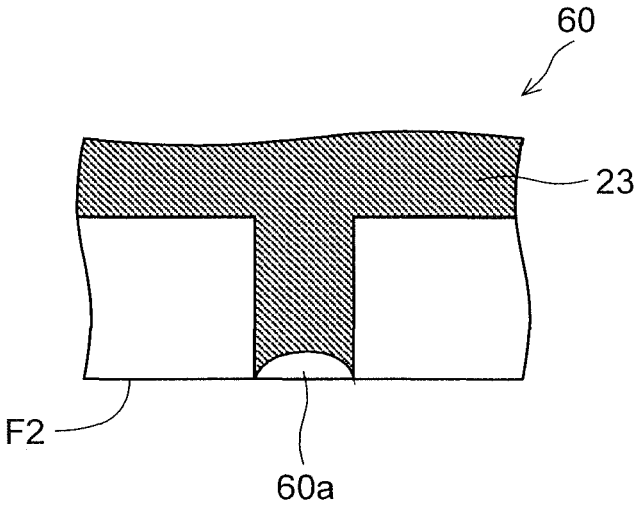
FIG. 9 A diagram showing the structure of a cleaning liquid supplying opening in the cleaning liquid supplying member of the recording head, illustrating a state where a meniscus of cleaning liquid is formed at the cleaning liquid supplying opening.

When recovery operation for the recording head 17 is performed, first, as shown in FIG. 8, the controller 110 (see FIG. 1) lowers the first conveying unit 5 located under the recording portion 9. The controller 110 then moves the wipe unit 19 arranged under the second conveying unit 12 horizontally to arrange it between the recording portion 9 and the first conveying unit 5. In this state, the wiper 35 (see FIG. 10) of the wipe unit 19 is arranged under the ink ejection face F1 and the cleaning liquid supplying face F2 (see FIG. 10) of the recording head 17. Here, as shown in FIG. 9, a meniscus of the cleaning liquid 23 is formed starting at the edge of the cleaning liquid supplying opening 60*a* so as to curve inward of the recording head 17. Moreover, the first valve 74*a* is closed and the second valve 74*b* is open.

Figure 10:
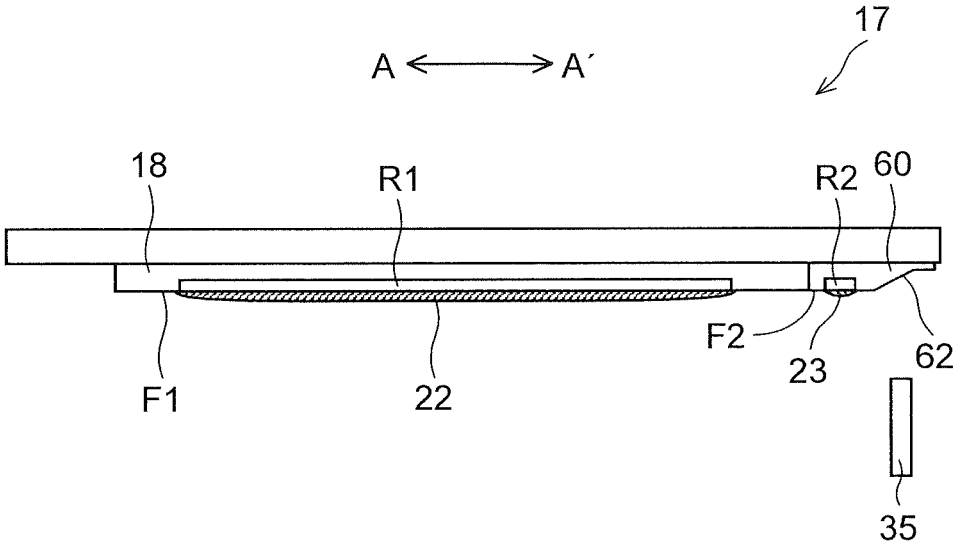
FIG. 10 A diagram showing a state where a wiper is arranged under the recording head.
Figure 11:
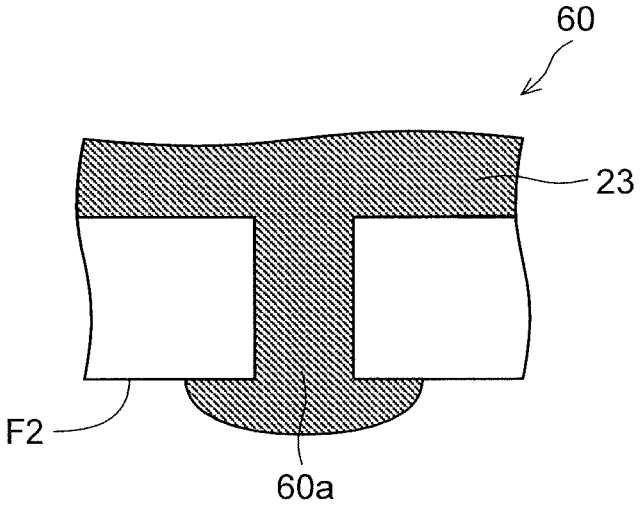
FIG. 11 A diagram showing the structure of the cleaning liquid supplying opening in the cleaning liquid supplying member of the recording head, illustrating a state where the cleaning liquid is supplied from the cleaning liquid supplying opening.

Cleaning Liquid Supplying Operation:

Prior to wiping operation (which will be described later), the controller 110 (see FIG. 1) supplies the cleaning liquid 23 to the recording head 17 as shown in FIG. 10. Specifically, the controller 110 closes the second valve 74*b* and then opens the first valve 74*a*. Then, when the drive motor 53 rotates forward, the piston 72*b* moves in the extraction direction (upward in FIG. 7) with respect to the cylinder 72*a*, and the cleaning liquid 23 flows into the supplying pump 72 via the first supplying path 70*a*. Then, the controller 110 closes the first valve 74*a* and then opens the second valve 74*b*. When the drive motor 53 rotates backward, the piston 72*b* moves in the insertion direction (downward in FIG. 7) with respect to the cylinder 72*a*, and the cleaning liquid 23 is supplied to the recording head 17 via the second supplying path 70*b*. Here, the cleaning liquid 23 goes into the state shown in FIG. 11. That is, the cleaning liquid 23 is retained under the surface tension in a state overflowing around the cleaning liquid supplying opening 60*a*.

Ink Pushing Out Operation:

Prior to wiping operation (which will be described later), the controller 110 (see FIG. 1) supplies ink 22 to the recording head 17 as shown in FIG. 10. The supplied ink 22 is pushed (purged) forcibly out of the ink ejection openings 18*a*. By this purging operation, thickened ink, foreign matter and air bubbles inside the ink ejection openings 18*a* are discharged from the ink ejection openings 18*a*. Here, the purged ink 22 is pushed out to the ink ejection face F1 along the shape of the ink ejection region R1 in which the ink ejection openings 18*a* lie. In the diagram, the ink (purged ink) 22 is indicated by hatching to facilitate understanding.

Figure 12:
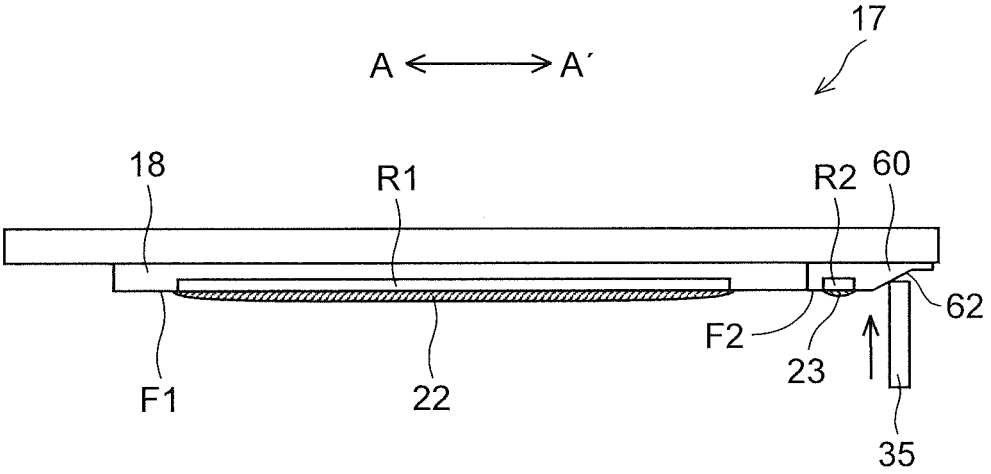
FIG. 12 A diagram showing a state where the wiper is raised from the state in FIG. 10 to be pressed into contact with the cleaning liquid supplying member.

Wiping Operation:

The controller 110, as shown in FIG. 12, raises the wiper 35 so that the wiper 35 makes contact with the inclined face 62 of the cleaning liquid supplying member 60 of the recording head 17 with a predetermined pressure. Here, the wiper 35 is raised so that the top face of the wiper 35 is approximately 1 mm higher than the ink ejection face F1 and the cleaning liquid supplying face F2. When the wiper 35 has just been raised, it does not need to be in pressed contact with the inclined face 62. That is, the wiper 35 may be raised at a position further to the right in FIG. 12.

Figure 13:
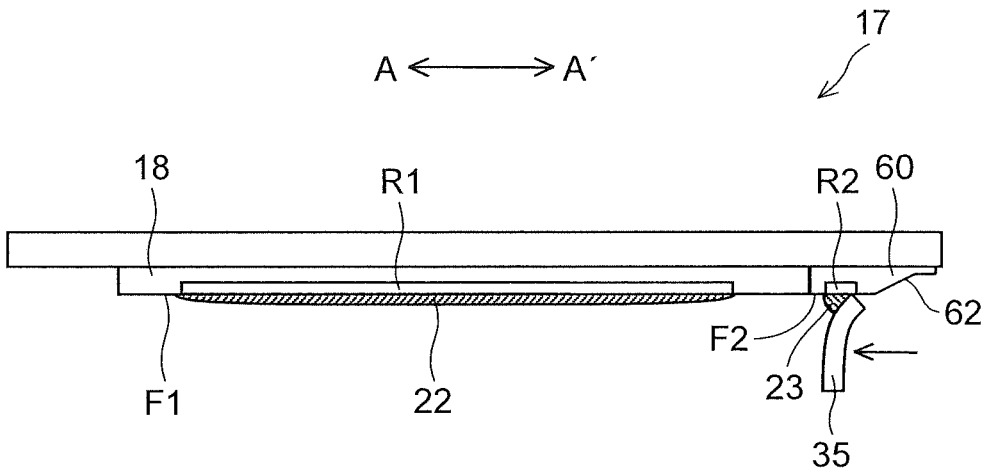
FIG. 13 A diagram showing a state where the wiper in pressed contact with the cleaning liquid supplying member is moved in the arrow A direction from the state in FIG. 12.
Figure 14:
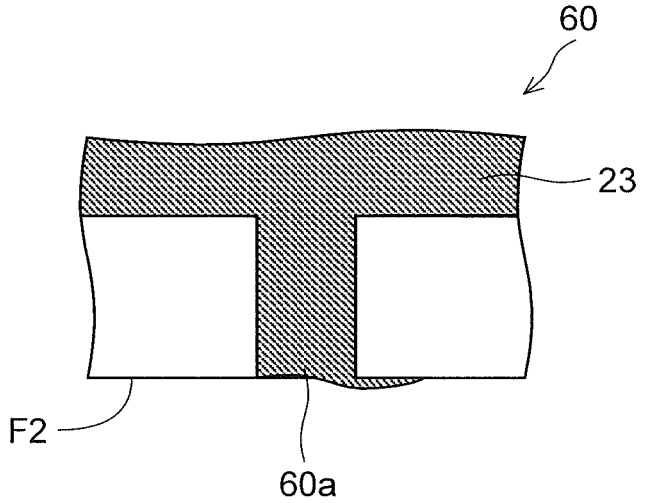
FIG. 14 A diagram showing the structure of the cleaning liquid supplying opening in the cleaning liquid supplying member of the recording head, illustrating a state after the cleaning liquid supplying face is wiped by the wiper.

The controller 110 moves the wiper 35 from a state in FIG. 12 in the direction toward the ink ejection region R1 (arrow A direction) as shown in FIG. 13 along the cleaning liquid supplying face F2. In this way, the wiper 35 scrapes off the cleaning liquid 23 that protrudes downward from the cleaning liquid supplying face F2 (here, also a part of the cleaning liquid 23 inside the cleaning liquid supplying openings 60*a* is moved to the wiper 35 side), and thereby the wiper 35 moves toward the ink ejection region R1 while retaining the cleaning liquid 23. Here, as shown in FIG. 14, the cleaning liquid 23 on the cleaning liquid supplying member 60 may be left around the cleaning liquid supplying openings 60*a*.

Figure 15:
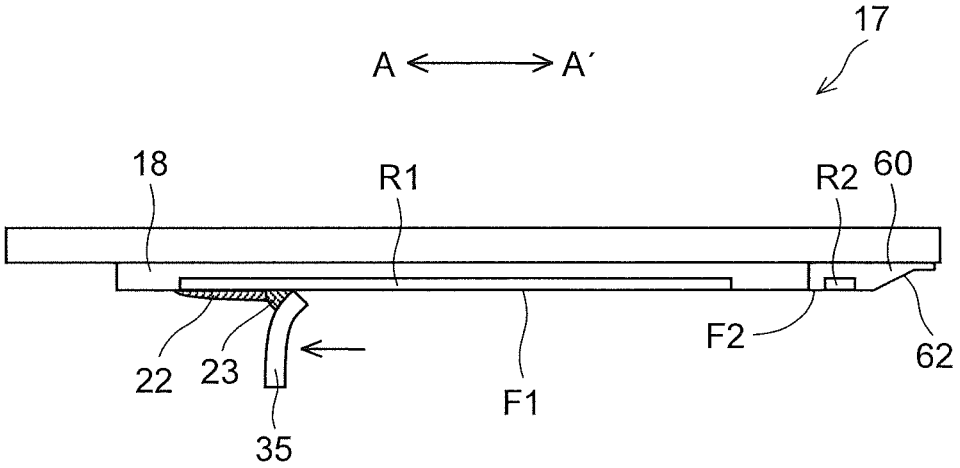
FIG. 15 A diagram showing a state where the wiper has been moved further in the arrow A direction from the state in FIG. 13.

As shown in FIG. 15, the wiper 35, while keeping retaining the cleaning liquid 23, moves on the ink ejection face F1 leftward (in the arrow A direction). Here, ink droplets (waste ink) which have attached to the ink ejection face F1 and solidified are dissolved by the cleaning liquid 23 and ink (purged ink) 22 and are wiped off by the wiper 35. When the wiper 35 moves further leftward (in the arrow A direction) to reach a position at the side opposite to the cleaning liquid supplying region R2 relative to the ink ejection region R1, the leftward movement is stopped. The cleaning liquid 23 and the waste ink wiped off by the wiper 35 are collected in a cleaning liquid collection tray (unillustrated) provided in the wipe unit 19.

Backflow Operation:

Here, in this embodiment, the controller 110, during wiping operation, controls the liquid supply mechanism 75 to make the cleaning liquid 23 in the cleaning liquid supplying path 70 flow backward in the direction pointing from the cleaning liquid supplying openings 60*a* to the subtank 71. Specifically, the controller 110, after the tip end of the wiper 35 passes the cleaning liquid supplying region R2 and before it reaches the ink ejection region R1, makes the drive motor 53 rotate slightly forward with the first valve 74*a* closed and the second valve 74*b* open. As a result, the piston 72*b* moves several millimeters in the extraction direction with respect to the cylinder 72*a*, and this causes the cleaning liquid 23 to flow backward in the direction pointing from the cleaning liquid supplying openings 60*a* to the supplying pump 72. This backflow operation causes the cleaning liquid 23 (see FIG. 14) around the cleaning liquid supplying openings 60*a* to be sucked into the cleaning liquid supplying openings 60*a*, and as shown in FIG. 9, a meniscus of the cleaning liquid 23 is formed starting at the edge of the cleaning liquid supplying openings 60*a* so as to curve inward of the recording head 17.

Figure 16:
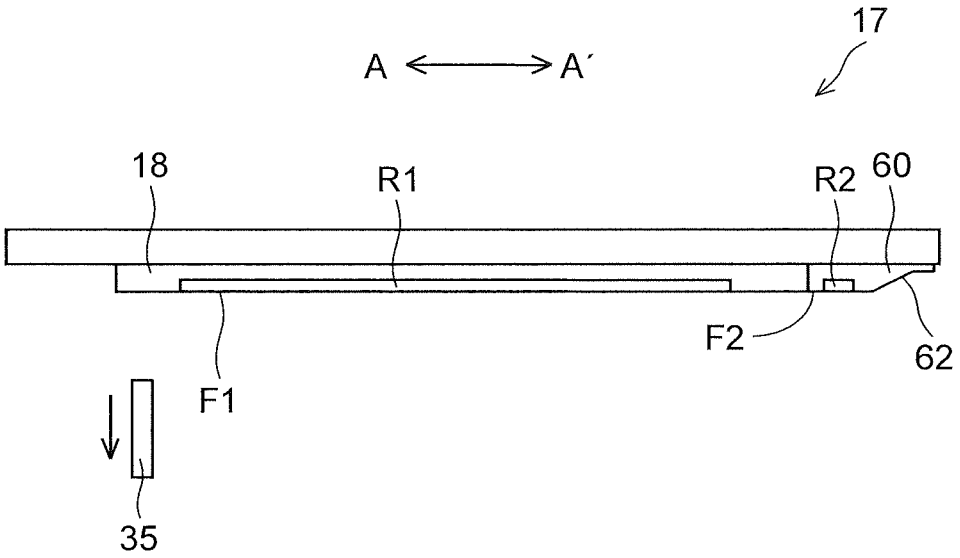
FIG. 16 A diagram showing a state where the wiper has been moved further in the arrow A direction from the state in FIG. 15 and then lowered so that it leaves the ink ejection face.

Separating Operation:

After wiping operation, as shown in FIG. 16, the controller 110 lowers the wiper 35 to separate it from the ink ejection face F1.

Finally, the controller 110 moves the wipe unit 19 arranged between the recording portion 9 and the first conveying unit 5 horizontally to arrange it under the second conveying unit 12, and raises the first conveying unit 5 up to a predetermined position. Recovery operation for the recording head 17 is thus finished.

In this embodiment, as mentioned above, cleaning liquid supplying operation in which the cleaning liquid 23 is supplied from the cleaning liquid supplying openings 60*a* as well as wiping operation in which the wiper 35 wipes the ink ejection face F1 while retaining the cleaning liquid 23 are performed. In this way, the ink ejection face F1 can be cleaned.

Moreover, the liquid supply mechanism 75 performs backflow operation in which the cleaning liquid 23 in the cleaning liquid supplying path 70 is made to flow backward in the direction pointing from the cleaning liquid supplying openings 60*a* to the subtank 71. This makes it possible to prevent the cleaning liquid 23 from being left around the cleaning liquid supplying openings 60*a* after recovery processing for the recording head 17 is performed. This helps prevent, even if a sheet S touches the recording head 17, the cleaning liquid 23 from attaching to and soiling the sheet S. This also helps prevent the cleaning liquid 23 from dropping from the cleaning liquid supplying openings 60*a*, and thus it is possible to prevent the cleaning liquid 23 from attaching to the first conveying belt 8 and the like and soiling the inside of the device.

As mentioned above, the supplying pump 72 is a syringe pump having a cylinder 72*a* and a piston 72*b* which is inserted in the cylinder 72*a* and which is reciprocatable. The amount of backflow of the cleaning liquid 23 can be thus controlled according to the moving distance of the piston 72*b*, and this makes fine adjustment of the amount of backflow of the cleaning liquid 23 possible. This helps easily prevent too much of the cleaning liquid 23 from flowing backward. That is, a meniscus of the cleaning liquid 23 can be easily formed near the cleaning liquid supplying opening 60*a*.

As mentioned above, during backflow operation, the piston 72*b* is moved in the extraction direction with respect to the cylinder 72*a* with the first valve 74*a* closed and the second valve 74*b* open. With this, the cleaning liquid 23 is made to flow backward easily.

As mentioned above, backflow operation causes a meniscus of the cleaning liquid 23 to form starting at the edge of the cleaning liquid supplying opening 60*a* so as to curve inward of the recording head 17. This allows an appropriate amount of cleaning liquid 23 to be easily supplied from the cleaning liquid supplying openings 60*a* during the next cleaning liquid supplying operation.

As mentioned above, backflow operation is performed after the wiper 35 passes the cleaning liquid supplying region R2 and before it reaches the ink ejection region R1. This allows backflow operation to be performed right after (at the earliest timing after) the wiper 35 passes the cleaning liquid supplying region R2, and thus it is possible to reliably prevent the cleaning liquid 23 from dropping from the cleaning liquid supplying openings 60*a*.

As mentioned above, the recording head 17 is composed of the head portion 18 having the ink ejection face F1 and the cleaning liquid supplying head portion 60 having the cleaning liquid supplying face F2. This allows the path of the ink and the path of the cleaning liquid in the recording head 17 to be formed in different members (the head portion 18 and the cleaning liquid supplying head portion 60), and thus it is possible to prevent the structure of the recording head 17 from becoming complicated.

The embodiments disclosed above should be understood to be in every aspect illustrative and not restrictive. The scope of the present invention is defined not by the description of the embodiments given above but by the appended claims, and should be understood to encompass any modifications made in the sense and scope equivalent to those of the claims.

Figure 17:
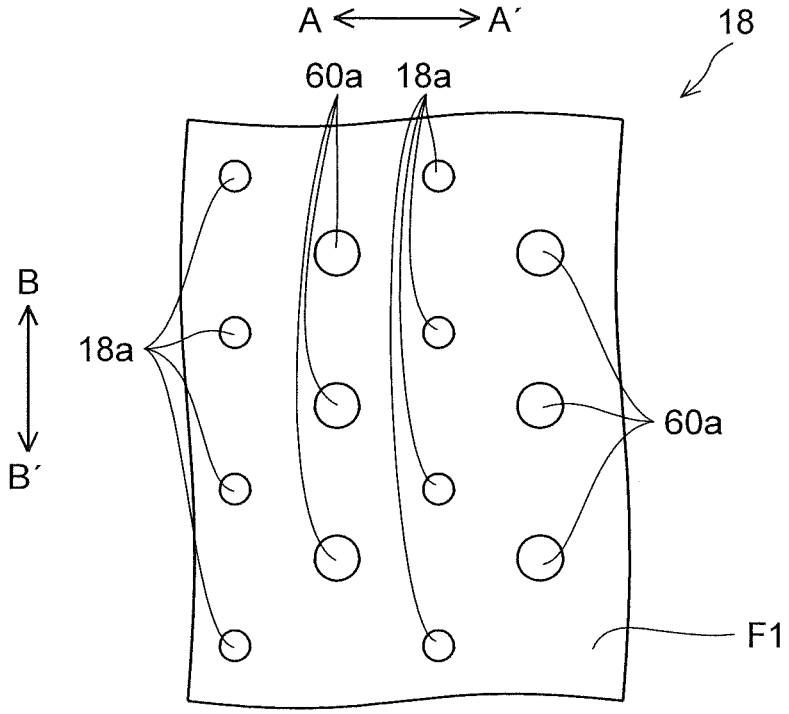
FIG. 17 A diagram showing a head portion of the recording head according to a modified example of the present invention as seen from below.

For example, although the above embodiments deal with an example where the cleaning liquid supplying member 60 in which the cleaning liquid supplying openings 60*a* are formed is provided separately from the head portion 18, this is not meant to limit the present invention. Instead of the cleaning liquid supplying member 60 being provided, the cleaning liquid supplying openings 60*a* may be formed in the head portion 18. Here, as in the recording head 17 in a modified example according to the present invention shown in FIG. 17, the cleaning liquid supplying openings 60*a* may be arranged adjacent to the ink ejection openings 18*a* (for example, the ink ejection openings 18*a* and the cleaning liquid supplying openings 60*a* may be arranged alternately).

For another example, although the above embodiments deal with an example where a syringe pump is used as the supplying pump 72, a pump other than the syringe pump, such as a tube pump or a diaphragm pump, may also be used as a supplying pump 72.

For another example, although the above embodiments deal with an example where backflow operation is performed while wiping operation is performed, backflow operation may be performed after wiping operation is performed.

For another example, although the above embodiments deal with an example where backflow operation is performed using the supplying pump 72, this is not meant to limit the present invention. For example, if the subtank 71 is arranged below the cleaning liquid supplying face F2 of the recording head 17, the first valve 74*a* and the second valve 74*b* of the liquid supply mechanism 75 may be opened so that a negative pressure is applied to the cleaning liquid 23 in the cleaning liquid supplying openings 60*a* to cause the cleaning liquid 23 to flow backward.

Although the above embodiments deal with an example where recovery operation for the recording head 17 is performed using the cleaning liquid 23 and the ink (purged ink) 22, recovery operation for the recording head 17 may be performed using only the cleaning liquid 23. That is, ink pushing out operation does not necessarily need to be performed.

Any configurations achieved by combining the configurations of the embodiments and modified examples described above are also within the technical scope of the present invention.

The invention claimed is:

1. A method for recovery of a recording head which includes an ink ejection face in which a plurality of ink ejection openings for ejecting ink on a recording medium are open, and a plurality of cleaning liquid supplying openings for supplying the cleaning liquid which are arranged upstream of the ink ejection openings in a wiping direction in which a wiper wipes the ink ejection face, the recording head being connected to a cleaning liquid tank for storing the cleaning liquid via a cleaning liquid supplying path, the method comprising:

cleaning liquid supplying operation for supplying the cleaning liquid from the cleaning liquid supplying openings by making a liquid supply mechanism provided in the cleaning liquid supplying path and including a liquid supplying pump supply the cleaning liquid in the cleaning liquid tank to the recording head via the cleaning liquid supplying path;

wiping operation for wiping the ink ejection face while the wiper retains the cleaning liquid after performing the cleaning liquid supplying operation; and backflow operation for controlling the liquid supply mechanism to make the cleaning liquid in the cleaning liquid supplying path to flow backward in a direction pointing from the cleaning liquid supplying openings to the cleaning liquid tank while or after the wiping operation is performed, wherein the recording head includes an ink ejection region in which the plurality of ink ejection openings are open, and a cleaning liquid supplying region which is arranged upstream of the ink ejection region in the wiping direction and in which the plurality of cleaning liquid supplying openings are open, and the backflow operation is performed after the wiper passes the cleaning liquid supplying region and before the wiper reaches the ink ejection region.

2. The method according to claim 1, wherein the liquid supplying pump is a syringe pump including a cylinder and a piston which is inserted in the cylinder and which is reciprocatable.

3. The method according to claim 2, wherein the cleaning liquid supplying path includes a first supplying path which connects together the cleaning liquid tank and the liquid supplying pump, and a second supplying path which connects together the liquid supplying pump and the recording head, the liquid supply mechanism includes a first valve which opens and closes the first supplying path, and a second valve which opens and closes the second supplying path, and during the backflow operation, the piston moves in an extraction direction with respect to the cylinder in a state where the first valve is closed and the second valve is open.

4. The method according to claim 1, wherein by the backflow operation, a meniscus of the cleaning liquid is formed starting at an edge of the cleaning liquid supplying openings so as to curve inward of the recording head.

5. The method according to claim 1, wherein the recording head includes an ink ejection head portion having the ink ejection face, and a cleaning liquid supplying head portion having a cleaning liquid supplying face in which the plurality of cleaning liquid supplying openings are open.

6. The method according to claim 1, wherein the recording head is arranged in an ink-jet recording apparatus.

* * * * *